US011604431B2

(12) United States Patent
Kojima

(10) Patent No.: US 11,604,431 B2
(45) Date of Patent: Mar. 14, 2023

(54) CLEANING COMPONENT, CLEANING APPARATUS USING SAME, PROCESS CARTRIDGE, AND IMAGE FORMING APPARATUS

(71) Applicant: FUJIFILM Business Innovation Corp., Tokyo (JP)

(72) Inventor: Noriaki Kojima, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/493,777

(22) Filed: Oct. 4, 2021

(65) Prior Publication Data

US 2022/0382206 A1 Dec. 1, 2022

(30) Foreign Application Priority Data

May 25, 2021 (JP) ..... JP2021-087571

(51) Int. Cl.
*G03G 21/00* (2006.01)

(52) U.S. Cl.
CPC ..... *G03G 21/0017* (2013.01)

(58) Field of Classification Search
CPC ..... G03G 21/0017
See application file for complete search history.

(56) References Cited

U.S. PATENT DOCUMENTS

| | | | | |
|---|---|---|---|---|
| 10,705,477 | B1 * | 7/2020 | Tano | G03G 21/0017 |
| 2004/0141779 | A1 * | 7/2004 | Yanagida | G03G 21/0017 399/350 |
| 2004/0170841 | A1 * | 9/2004 | Tomiyama | G03G 21/0017 428/422.8 |
| 2007/0134035 | A1 * | 6/2007 | Kageyama | G03G 21/0017 399/346 |
| 2007/0147893 | A1 * | 6/2007 | Nakatake | G03G 21/0017 399/350 |
| 2011/0229233 | A1 * | 9/2011 | Watanabe | G03G 21/0017 399/350 |
| 2016/0033924 | A1 * | 2/2016 | Fukao | G03G 21/0017 399/350 |
| 2018/0039223 | A1 * | 2/2018 | Miyagawa | G03G 21/0017 |

FOREIGN PATENT DOCUMENTS

| | | |
|---|---|---|
| JP | H08234639 | 9/1996 |
| JP | 4498200 | 7/2010 |
| JP | 2010210879 | 9/2010 |

* cited by examiner

*Primary Examiner* — Sandra Brase
(74) *Attorney, Agent, or Firm* — JCIPRNET

(57) ABSTRACT

A cleaning component that cleans an image holding section having a high-hardness surface layer, the cleaning component including: a plate-shaped cleaning member coming into contact with a surface of the image holding section, in which a portion of the cleaning member coming into contact with the surface of the image holding section has 100% modulus equal to or more than 7 Mpa and rebound resilience equal to or less than 30%, as physical properties.

17 Claims, 8 Drawing Sheets

FIG. 5

| | RELATED TO BLADE | | | | RELATED TO PHOTOCONDUCTOR | | | QUALITY: FILMING | | | |
|---|---|---|---|---|---|---|---|---|---|---|---|
| | BLADE (CONTACT PORTION WITH PHOTOCONDUCTOR) | FRICTION COEFFICIENT | BLADE VIBRATION (STICK-SLIP) | EXTERNAL ADDITIVE SLIP-THROUGH | PHOTOCONDUCTOR SURFACE | FRICTION COEFFICIENT | PHOTOCONDUCTOR SURFACE SCRATCH (ROUGHNESS SCRATCH) | SCRATCH RECESS PORTION | PHOTOCONDUCTOR SURFACE | BLADE CONTACT PRESSURE SETTING | UNIT LIFE |
| EXEMPLARY EMBODIMENT 1 | HIGH MODULUS AND LOW REBOUND RESILIENCE | SMALL | SMALL VIBRATION | SMALL (MODERATE) | OVERCOATED | LARGE | GREATLY SUPPRESSED | GREATLY SUPPRESSED | GREATLY SUPPRESSED | LOW | LONG |
| COMPARATIVE EXAMPLE 1 | HIGH MODULUS AND LOW REBOUND RESILIENCE | SMALL | SMALL VIBRATION | SMALL (MODERATE) | OPC | LARGE | OCCURRENCE | OCCURRENCE | GREATLY SUPPRESSED | HIGH | SHORT |
| COMPARATIVE EXAMPLE 2 | RELATED ART | LARGE | LARGE VIBRATION | LARGE (EXCESS) | OPC | SMALL | OCCURRENCE | OCCURRENCE | OCCURRENCE | HIGH | SHORT |
| COMPARATIVE EXAMPLE 3 | RELATED ART | LARGE | LARGE VIBRATION | LARGE (EXCESS) | OVERCOATED | LARGE | GREATLY SUPPRESSED | GREATLY SUPPRESSED | OCCURRENCE (ENTIRE SURFACE) | HIGH | SHORT |

FIG. 6A

| | COMPARATIVE EXAMPLE 2 | COMPARATIVE EXAMPLE 3 (HIGH MODULUS AND HIGH REBOUND RESILIENCE) | EXEMPLARY EMBODIMENT 1 (HIGH MODULUS AND LOW REBOUND RESILIENCE) |
|---|---|---|---|
| MODULUS | LOW | HIGH | HIGH |
| REBOUND RESILIENCE | HIGH | HIGH | LOW |
| BLADE VIBRATION | LARGE AMPLITUDE, SMALL PERIOD | SMALL AMPLITUDE, SMALL PERIOD | SMALL AMPLITUDE, LARGE PERIOD |
| BLADE VIBRATION SCHEMATIC DIAGRAM | 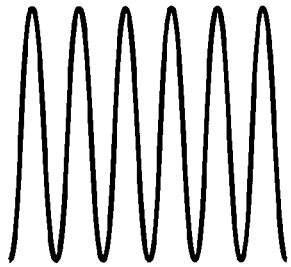  | 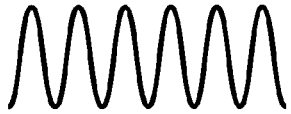 | 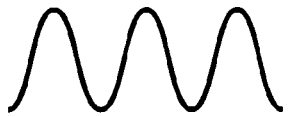 |
| EXTERNAL ADDITIVE SLIP-THROUGH | GOOD | FAIR | POOR |

FIG. 6B

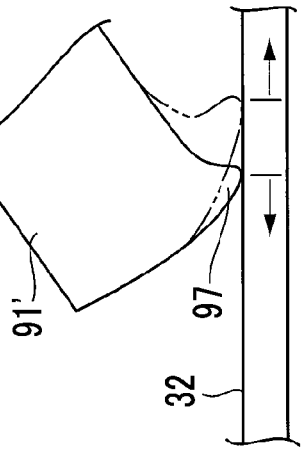

CLEANING COMPONENT, CLEANING APPARATUS USING SAME, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2021-087571 filed May 25, 2021.

BACKGROUND

(i) Technical Field

The present invention relates to a cleaning component, a cleaning apparatus using the same, a process cartridge, and an image forming apparatus.

(ii) Related Art

In the related art, for example, cleaning components described in JP1996-234639A, JP4498200B, and JP2010-210879A are previously known.

JP1996-234639A, discloses an aspect in which preferable physical properties (hardness of elastic body, Young's modulus, 100% modulus, rebound resilience, and the like) are specified for a cleaning blade of a cleaning apparatus that cleans a surface of an image carrier consisting of an organic photoconductor.

JP4498200B, discloses an aspect in which preferable physical properties (hardness, 100% modulus, rebound resilience, and the like) of a cleaning blade are specified with respect to a configuration in which a specific inorganic fine powder is supplied to a surface of an image carrier.

JP2010-210879A discloses an aspect in which rebound resilience of a cleaning blade is specified for a photoconductor and a friction-reducing treatment is executed on a tip portion.

SUMMARY

Aspects of non-limiting embodiments of the present disclosure relate to a cleaning component, a cleaning apparatus using the same, a process cartridge, and an image forming apparatus that clean an image holding section including a high-hardness surface layer, suppresses vibration and slip-through of image forming residual particles at a contact portion with the image holding section, and extends a life, in a state where a contact pressure on the image holding section is reduced, as compared with a case of 100% modulus less than 7 MPa or rebound resilience more than 30%, a cleaning apparatus using the cleaning component, a process cartridge, and an image forming apparatus.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a cleaning component that cleans an image holding section having a high-hardness surface layer, the cleaning component including: a plate-shaped cleaning member coming into contact with a surface of the image holding section, in which a portion of the cleaning member coming into contact with the surface of the image holding section has 100% modulus equal to or more than 7 Mpa and rebound resilience equal to or less than 30%, as physical properties.

BRIEF DESCRIPTION OF THE DRAWINGS

Exemplary embodiment(s) of the present invention will be described in detail based on the following figures, wherein:

FIG. 5 is an explanatory diagram illustrating an application condition, a physical property, and a quality characteristic of a cleaning component according to Example and Comparative Examples 1 to 3;

FIG. 6A is an explanatory diagram illustrating a relationship between blade vibration, modulus, and a restitution coefficient of in FIGS. 4A to 4C, and FIG. 6B is an explanatory diagram schematically illustrating the blade vibration;

DETAILED DESCRIPTION

Outline of Exemplary Embodiment

Figure 1A:
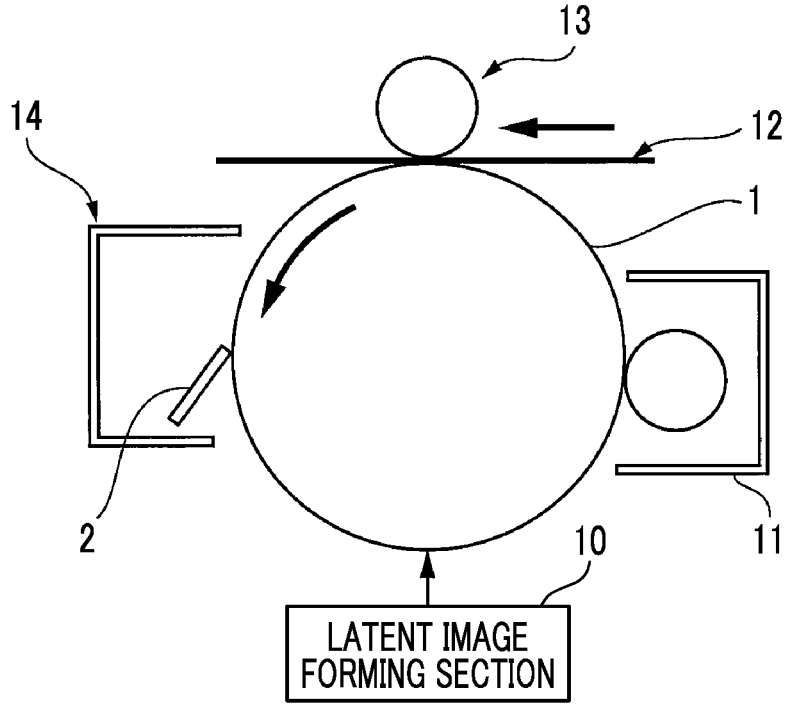
FIG. 1A is an explanatory diagram illustrating an outline of an exemplary embodiment of a cleaning apparatus and an image forming apparatus including a cleaning component to which the present disclosure is applied.

FIG. 1A is an explanatory diagram illustrating an outline of an exemplary embodiment of an image forming apparatus incorporating a cleaning apparatus including a cleaning component to which the present disclosure is applied.

Figure 1B:
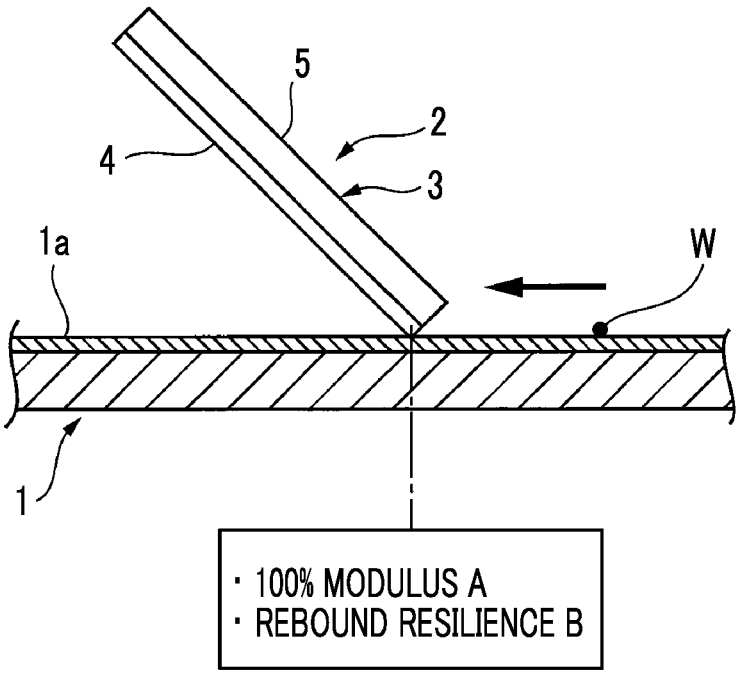
FIG. 1B is an explanatory diagram illustrating a central unit of the cleaning component illustrated in FIG. 1A.

In FIG. 1A, the image forming apparatus includes an image holding section 1 that includes a high-hardness surface layer 1*a*, a latent image forming section 10 that forms an electrostatic latent image on the image holding section 1, a developing section 11 that visualizes an electrostatic latent image formed on the image holding section 1 into an image forming particle, a transfer section that transfers a visible image formed on the image holding section 1 to a transfer medium 12, and a cleaning apparatus 14 that cleans an image forming residual particle w of the image holding section 1 (see FIG. 1B).

In such a technical section, a cleaning target by the cleaning apparatus 14 may be the image holding section 1 having the high-hardness surface layer 1*a*, and may be a photoconductor that requires the high-hardness surface layer 1*a* or the like.

Here, a shape of the image holding section 1 may be drum-shaped or belt-shaped, and the high-hardness surface layer 1*a* includes, for example, a surface protection layer different from a photoconductor that covers a surface of a photosensitive layer, as well as an aspect in which a surface of the photoconductor is cured and altered.

Further, the latent image forming section 10 may be any one that forms an electrostatic latent image, and as an aspect in which a photoconductor is used as the image holding section 1, there is a typical aspect in which a charging element and a light writing element (laser, LED writing head, or the like) is used in combination.

Further, the transfer medium 12 may be an intermediate transfer medium or a recording medium.

In the present exemplary embodiment, the cleaning apparatus 14 includes a cleaning component 2 to which the exemplary embodiment of the present invention is applied. The cleaning apparatus 14, that is one of components of the image forming apparatus, may be incorporated to a process cartridge detachably attached to an image forming apparatus housing, together with the image holding section 1 having the high-hardness surface layer 1*a*.

Here, as illustrated in FIG. 1B, the cleaning component 2 cleans the image holding section 1 having the high-hardness surface layer 1*a*, and has a plate-shaped cleaning member 3 coming into contact with a surface of the image holding section 1, and a physical property of a portion, of the cleaning member 3, coming into contact with the surface of the image holding section 1 is that 100% modulus is equal to or more than 7 Mpa and rebound resilience is equal to or less than 30%.

In the present example, in a case where the image holding section 1 is, for example, a photoconductor, the high-hardness surface layer 1*a* is widely included as long as the high-hardness surface layer 1*a* is at least harder than an organic photoconductor on which a surface hardening treatment or the like is not executed. Meanwhile, in the present application, hardness of the high-hardness surface layer 1*a* is described by using universal hardness, elastic deformation rate, or the like, that are hardness indexes.

Further, the cleaning member 3 needs to satisfy 100% modulus and a numerical value of a rebound resilience, and these numerical conditions need to be satisfied at least by "portion of cleaning member 3 coming into contact with surface of image holding section 1", and it is not always necessary to satisfy the above-described numerical condition for other portions.

Further, the fact that 100% modulus is equal to or more than 7 Mpa and the rebound resilience is equal to or less than 30% is a region in which occurrence of so-called filming is greatly suppressed, as a result of being used for the image holding section 1 having the high-hardness surface layer 1*a*. Details will be described in Examples.

Here, an upper limit value of 100% modulus is 15 MPa, and a lower limit value of rebound resilience is 5%. In a case where 100% modulus exceeds the upper limit or the rebound resilience exceeds the lower limit, rubber resilience is lowered, adhesion to the photoconductor is impaired, and slip-through occurs due to poor adhesion.

According to the present example, by a combination of a physical property of suppressing vibration of the cleaning member 3 and the fact that the surface of the image holding section 1 is hard (providing the high-hardness surface layer 1*a*), it is possible to suppress the slip-through of the image forming residual particle w (external additive or the like) and to prevent roughness scratches, and it is possible to suppress the occurrence of the filming phenomenon. In the present example, since vibration is suppressed at a tip edge of the cleaning member 3, fatigue fracture (abrasion) is small and the surface of the image holding section 1 does not change. Therefore, by combining these facts, it becomes possible to reduce a contact pressure of the cleaning member 3, which leads to a longer life.

Next, a representative aspect or an exemplary aspect of the cleaning component according to the present exemplary embodiment will be described.

First, as an exemplary aspect of the cleaning member 3, for example, the cleaning member 3 includes a contact member 4 having a portion coming into contact with the surface of the image holding section 1, and a non-contact member 5 having a portion that does not come into contact with the surface of the image holding section 1, and 100% modulus of the non-contact member 5 is made smaller than 100% modulus of the contact member 4.

This example is preferable in that necessary physical properties for the cleaning member 3 may be easily constructed, as compared with a case where the cleaning member 3 has a single-phase configuration, for example. Further, the aspect of the present example includes not only a multi-layered aspect in which plate members of the contact member 4 and the non-contact member 5 are stacked, but also only a tip contact portion coming into contact with the image holding section 1 with respect to most of the non-contact members 5 is designated as the contact member 4.

The aspect in which the cleaning member 3 includes the contact member 4 and the non-contact member 5 may include an aspect in which the contact member 4 and the non-contact member 5 are made of identical materials having 100% modulus different from each other, or the contact member 4 and the non-contact member 5 are made of different materials having 100% modulus different from each other.

Further, the cleaning member 3 of the present example may be brought into contact with the surface of the image holding section 1 with a contact pressure of 2 to 4 (corresponding to gf/mm→9.80665 $g \cdot m/s^2$).

Further, for example, the exemplary aspect of the cleaning member 3 includes an aspect in which a portion coming into contact with the surface of the image holding section 1 is adjusted to a predetermined friction coefficient of 0.1 to 1.5 by using at least any rubber material of polyurethane rubber, silicone rubber, or fluororubber.

Here, as a method of adjusting the friction coefficient, the friction coefficient is adjusted by adjusting hardness of a rubber material. Alternatively, the friction coefficient may be adjusted by modifying a surface of the rubber material. A surface modification treatment includes an ultraviolet irradiation treatment and an isocyanate impregnation treatment.

Further, for example, as an exemplary configuration example of the cleaning member 3, the portion coming into contact with the surface of the image holding section 1 is configured by using at least polyurethane rubber, and is obtained by selecting types, molar ratios, and curing/maturing conditions of a polyol component and a polyisocyanate component that are composition components of the polyurethane rubber, so as to satisfy the physical properties of 100% modulus and rebound resilience.

Further, for example, the exemplary image holding section 1 for such a cleaning component includes an aspect in which the friction coefficient after 10 kpv running is 0.3 to 0.7. This example is preferable in that cleaning performance of the image holding section 1 is ensured even in a case where the friction coefficient of the surface of the image holding section 1 is not set to 0.1 to 0.2.

Further, as a method of adjusting a friction resistance of the surface of the image holding section 1, the amount of lubricant particles to be added to the high-hardness surface layer 1*a* may be adjusted.

Hereinafter, the present disclosure will be described in detail based on the exemplary embodiments illustrated in accompanying drawings.

Exemplary Embodiment 1

Figure 2:
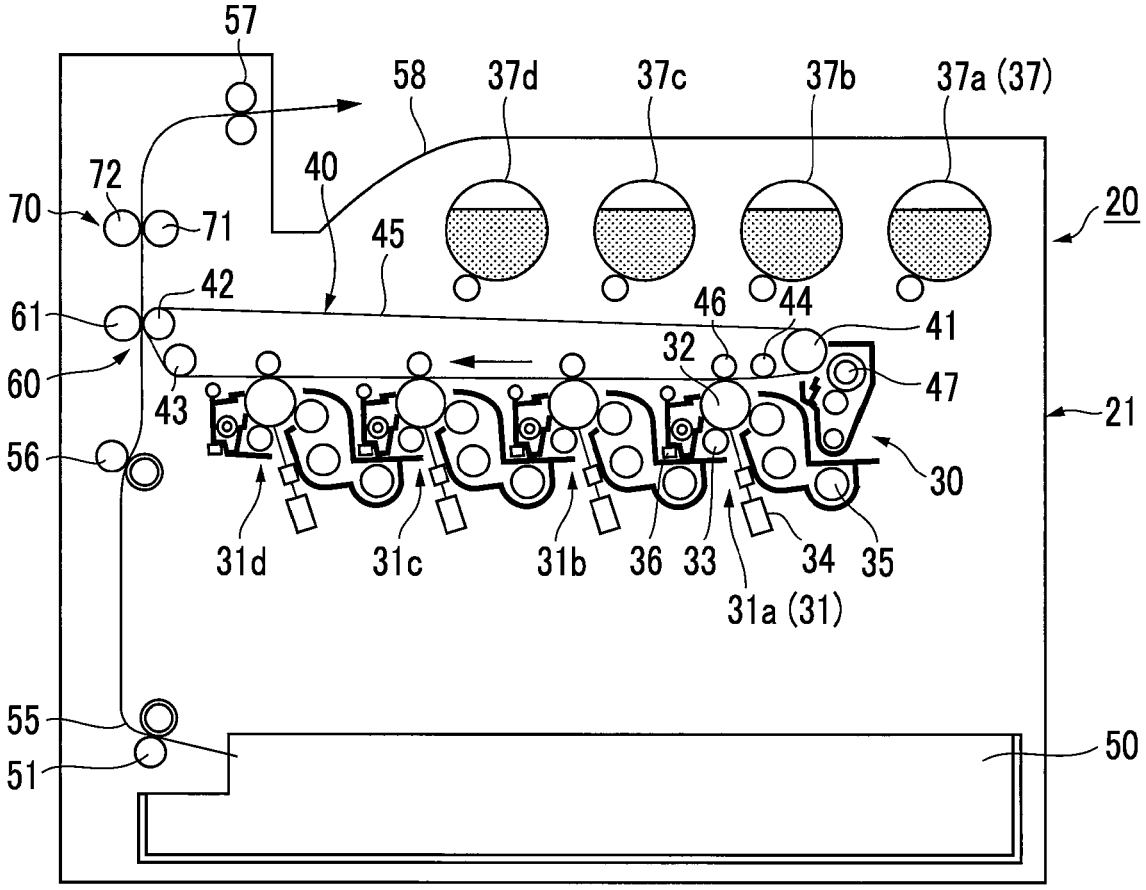
FIG. 2 is an explanatory diagram illustrating an overall configuration of an image forming apparatus according to Exemplary Embodiment 1.

Overall Configuration of Image Forming Apparatus FIG. 2 is an explanatory diagram illustrating an overall configuration of an image forming apparatus according to Exemplary Embodiment 1.

In FIG. 2, in an image forming apparatus 20, an image forming engine 30 that forms an image of a plurality of colors (four colors of yellow, magenta, cyan, and black in the present exemplary embodiment) is mount in an apparatus housing 21, a recording material supply apparatus 50 that accommodates recording materials such as paper is disposed below the image forming engine 30, and a recording material transporting path 55 from the recording material supply apparatus 50 is disposed in a substantially vertical direction.

In the present example, in the image forming engine 30, image forming units 31 (specifically, 31*a* to 31*d*) that forms the image of the plurality of colors are arranged in a substantially horizontal direction, a transfer module 40 including, for example, a belt-shaped intermediate transfer body 45 that circulates and moves along the arrangement direction of the image forming unit 31 is disposed above the image forming unit 31, and an image of each color formed by each of the image forming units 31 is transferred to the recording material via the transfer module 40.

In the present exemplary embodiment, as illustrated in FIGS. 2 and 3, each of the image forming units 31 (31*a* to 31*d*) forms, for example, a toner image for yellow, for magenta, for cyan, and for black, in order from an upstream side in a circulation direction of the intermediate transfer body 45 (arrangement is not necessarily in this order), and includes a photoconductor 32, a charger (charging roll in this example) 33 that precharges the photoconductor 32, an exposure device (LED writing head in this example) 34 that writes an electrostatic latent image on each photoconductor 32 charged by the charger 33, a developing device 35 that develops the electrostatic latent image formed on the photoconductor 32 with a corresponding color component toner (for example, a negative electrode in the present exemplary embodiment), and a cleaner 36 (corresponding to the cleaning apparatus 14 illustrated in FIG. 1A) that cleans a residue on the photoconductor 32.

Reference numerals 37 (specifically, 37*a* to 37*d*) are toner cartridges that supply each color component toner to each developing device 35.

Further, in the present exemplary embodiment, the transfer module 40 includes the belt-shaped intermediate transfer body 45 spanned over a plurality of tension rolls 41 to 44, and for example, the tension roll 41 is used as a driving roll to circulate and move the intermediate transfer body 45. A transfer device (transfer roll in this example) 46 for primary transfer is disposed on a back surface of the intermediate transfer body 45 facing the photoconductor 32 of each of the image forming units 31, and by applying a transfer voltage having a polarity opposite to a charging polarity of the toner to the transfer device 46, the toner image on the photoconductor 32 is electrostatically transferred to the intermediate transfer body 45 side.

Further, a belt cleaner 47 is disposed on the upstream side of the most upstream image forming unit 31*a* of the intermediate transfer body 45 so as to remove a residual toner on the intermediate transfer body 45.

Further, in the present exemplary embodiment, a secondary transfer device 60 is disposed at a portion facing the tension roll 42 on the downstream side of the most downstream image forming unit 31*d* of the intermediate transfer body 45, and a primary transfer image on the intermediate transfer body 45 is secondarily transferred (collectively transferred) to the recording material.

In the present example, the secondary transfer device 60 includes a secondary transfer roll 61 disposed by press-contacting a toner image holding surface side of the intermediate transfer body 45, and a backup roll that is disposed on the back surface side of the intermediate transfer body 45 and forms a counter electrode of the secondary transfer roll 61 (the tension roll 42 is also used in this example). For example, the secondary transfer roll 61 is grounded, and a secondary transfer voltage having the same polarity as the charging polarity of the toner is applied to the backup roll (the tension roll 42).

Further, a supply roll 51 that supplies the recording material is provided in the recording material supply apparatus 50, a transfer roll (not illustrated) is disposed in the recording material transporting path 55, and a positioning roll (registration roll) 56 that supplies the recording material to a secondary transfer portion at a predetermined timing is disposed in the recording material transporting path 55 located immediately before the secondary transfer portion.

Further, a fixing machine 70 is provided in the recording material transporting path 55 located on the downstream side of the secondary transfer portion, and the fixing machine 70 includes, for example, a heat fixing roll 71 in which a heating heater (not illustrated) is built, and a pressure fixing roll 72 that is disposed in press-contact with the heat fixing roll 71 and rotates following the heat fixing roll 71. Further, an output roll 57 that outputs the recording material in the apparatus housing 21 is provided on the downstream side of the fixing machine 70, and the recording material is sandwiched, transported, and output, and the recording material formed on an upper portion of the apparatus housing 21 is accommodated in a recording material storage 58.

Although not illustrated in the present example, of course, a manual supply apparatus for recording material or a double-sided recording module capable of double-sided recording of the recording material may be separately provided.

Configuration Example of Image Forming Unit

Photoconductor

Figure 3A:
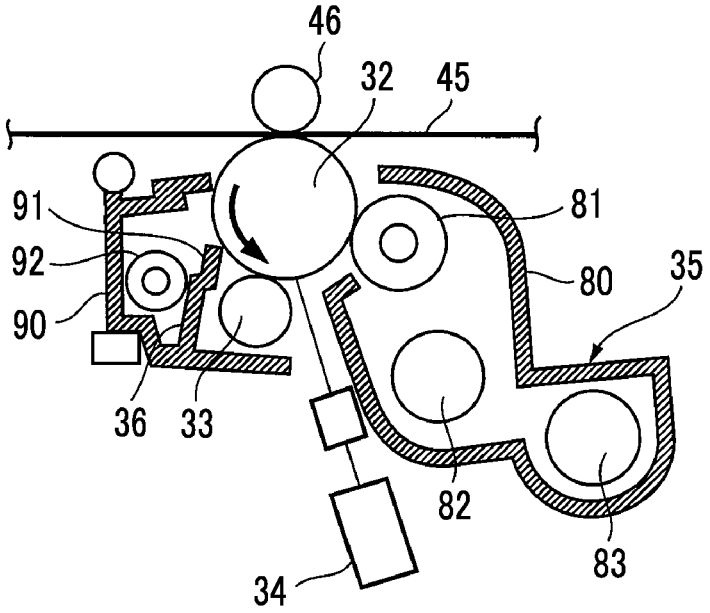
FIG. 3A is an explanatory diagram illustrating a cleaning apparatus and a process cartridge used in Exemplary Embodiment 1.
Figure 3B:
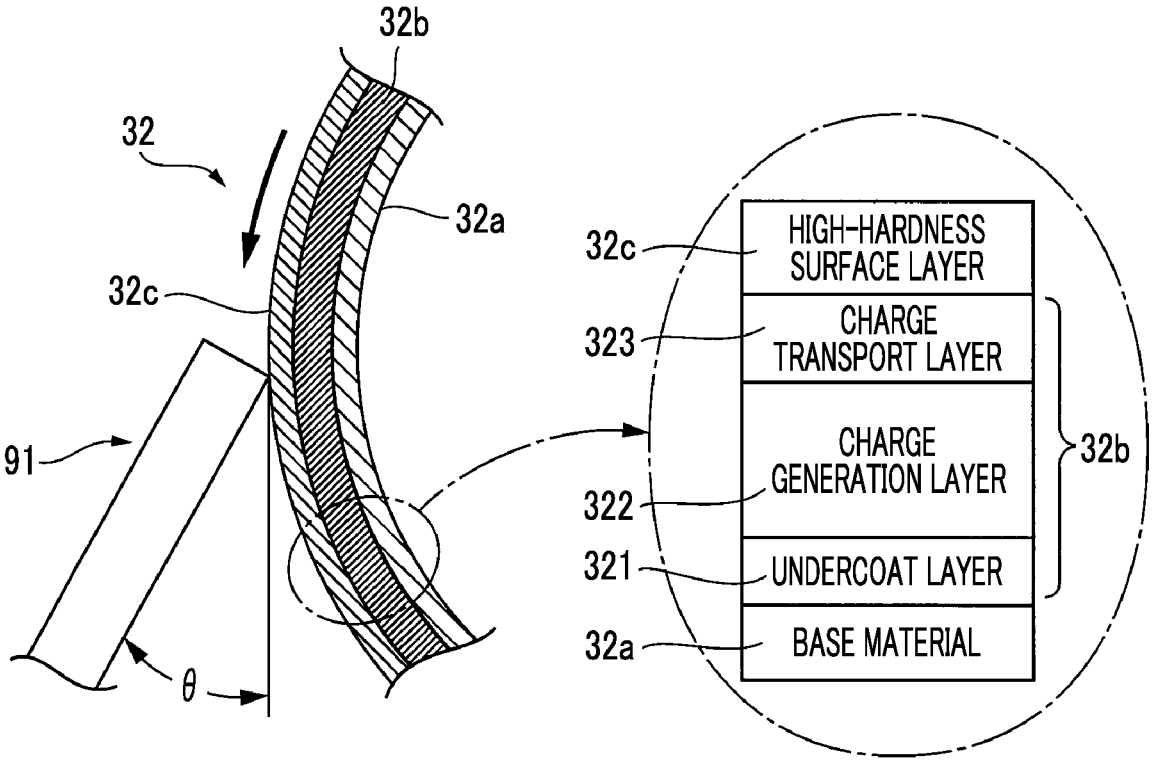
FIG. 3B is an explanatory diagram illustrating a cleaning component and a photoconductor having a high-hardness surface layer illustrated in FIG. 3A.

In the present example, as illustrated in FIGS. 3A and 3B, the photoconductor 32 has a photosensitive layer (organic photosensitive layer in the present example) 32*b* stacked on a metal (aluminum in the present example) base material 32*a*, and a high-hardness surface layer 32*c* having an excellent abrasion resistance stacked on the photosensitive layer 32*b*.

Here, the photosensitive layer 32*b* is formed by sequentially stacking an undercoat layer 321, a charge generation layer 322, and a charge transport layer 323 on the base material 32*a*, and the undercoat layer 321 blocks injection of a counter charge (+) generated by charging, and the charge generation layer 322 generates a charge (+−) by photoelectric conversion. Further, the charge transport layer 323 transports the charge (+) generated in the charge generation layer 322 to the high-hardness surface layer 32*c*. Further, the high-hardness surface layer 32*c* may be formed of a high-hardness material so as to prevent abrasion of the photosensitive layer 32*b*.

A specific example of the high-hardness surface layer 32*c* will be described below.

Developing Device

In the present example, as illustrated in FIG. 3A, the developing device 35 includes a developing container 80 in which a developer including a toner and a carrier is accommodated and that opens toward the photoconductor 32, a developing roll 81 is disposed in an opening of the developing container 80, the developer held in the developing roll 81 is supplied to a portion facing the photoconductor 32, and agitation and transport members 82 and 83 for agitating and charging the developer, and agitating and transporting the developer are disposed in the developing container 80.

Cleaner

Further, in the present example, the cleaner 36 includes a cleaning container 90 that accommodates a residue on the photoconductor 32 and opens toward the photoconductor 32, a cleaning blade 91 as a plate-shaped cleaning member for scraping the residue on the photoconductor 32 is attached to an opening edge of the cleaning container 90, and a transport member 92 for transporting the accommodated residue so as to be leveled is disposed in the cleaning container 90.

Configuration Example of Cleaning Blade

In the present example, as illustrated in FIG. 3B, the cleaning blade 91 is a long thin plate-shaped member extending in an axial direction of the drum-shaped photoconductor 32, supports a side of the plate-shaped member away from the photoconductor 32 in a lateral direction intersecting a longitudinal direction with a support bracket (not illustrated), and is disposed so that an edge portion of the plate-shaped member on the photoconductor 32 side (tip side) in the lateral direction is disposed coming into contact with the photoconductor 32.

Figure 4A:
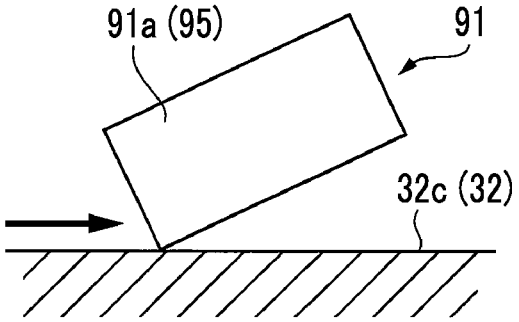
FIGS. 4A to 4C are explanatory diagrams illustrating a configuration example of the cleaning component according to Exemplary Embodiment 1.
Figure 4B:
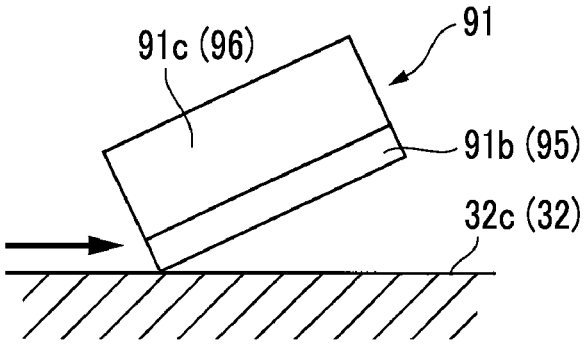

In the present example, an example of the cleaning blade 91 includes an aspect in which, for example, one plate-shaped member 91*a* functions as a contact member 95 coming into contact with the photoconductor 32 in a single-layer structure consisting of the one plate-shaped member 91*a*, as illustrated in FIG. 4A, or an aspect of a two-layer structure in which two plate-shaped members 91*b* and 91*c* are stacked, one plate-shaped member 91*b* functions as the contact member 95 coming into contact with the photoconductor 32, and the other plate-shaped member 91*c* functions as a non-contact member 96 that is not coming into contact with the photoconductor 32, as illustrated in FIG. 4B. In the latter aspect, three or more layers may be stacked instead of the two-layer structure.

Figure 4C:
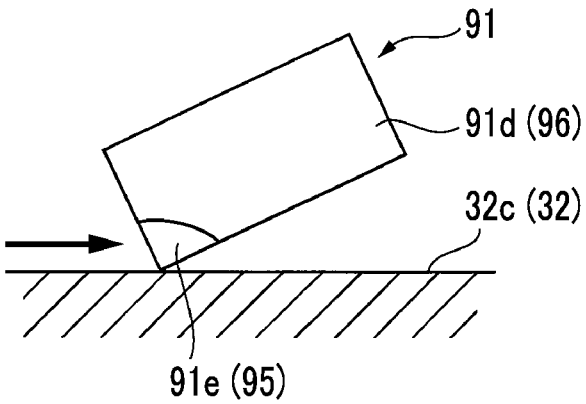

Further, as another configuration example of the cleaning blade 91, FIG. 4C illustrates an aspect in which a corner portion of one plate-shaped member 91*d* coming into contact with the photoconductor 32 is cut out, a corner portion 91*e* different from the one plate-shaped member 91*d* is fixed to the cutout portion, and the corner portion 91*e* functions as the contact member 95 coming into contact with the photoconductor 32.

Configuration Material of Cleaning Blade

Contact Member

In the present example, the contact member 95 is a polyurethane rubber including at least a polyol component and a polyisocyanate component. As needed, the polyurethane rubber may be a polyurethane rubber obtained by polymerizing a resin having a functional group capable of reacting with the isocyanate group of polyisocyanate, in addition to the polyol component.

Here, the polyol component includes a high molecular weight polyol and a low molecular weight polyol. A high molecular weight polyol component is a polyol having a number average molecular weight equal to or more than 500 (preferably equal to or more than 500 and equal to or less than 5000, for example). Examples of the high molecular weight polyol component include well-known polyols such as polyester polyol obtained by dehydration condensation of low molecular weight polyol and dibasic acid, polycarbonate polyol obtained by reaction of low molecular weight polyol and alkyl carbonate, polycaprolactone polyol, polyether polyol. The low molecular weight polyol component is a polyol having a molecular weight (number average molecular weight) less than 500. Examples of the low molecular weight polyol component include, in addition to 1,4-butanediol, diols (bifunctional), triol (trifunctional), tetraol (tetrafunctional), and the like, that are well known as chain length extenders and cross-linking agents. The low molecular weight polyol is a material that functions as a chain length extender and a cross-linking agent.

Examples of the polyisocyanate component include 4,4-diphenylmethane diisocyanate (MDI), 2,6-toluene diisocyanate (TDI), 1,6-hexamethylene diisocyanate (HDI), 1,5-naphthalene diisocyanate (NDI), 3,3-dimethylbiphenyl-4,4-diisocyanate (TODI), and the like.

Further, as will be described below, the contact member 95 needs to satisfy physical properties of 100% modulus and rebound resilience, and types, molar ratios, and curing/maturing conditions of the polyol component and the polyisocyanate component, that are composition components of the polyurethane rubber, may be appropriately selected to obtain appropriate characteristics.

Non-Contact Member

In the present example, as the non-contact member 96, any known material without particular limitation can be used as long as the material has a function of supporting the contact member 95. Specifically, examples of the material used for the non-contact member 96 include polyurethane rubber, silicone rubber, fluororubber, chloroprene rubber, butadiene rubber, and the like. Among polyurethane rubber, silicone rubber, fluororubber, proloprene rubber, and butadiene rubber, polyurethane rubber is preferable, for example. Examples of the polyurethane rubber include ester-based polyurethane and ether-based polyurethane, and ester-based polyurethane is particularly appropriate, for example.

Characteristics of Cleaning Blade

100% Modulus (M100)

In the present example, 100% modulus of a portion of the cleaning blade 91 coming into contact with a surface of the photoconductor 32 (high-hardness surface layer 32*c*) is selected to be equal to or more than 7 Mpa.

The 100% modulus is measured at a tensile speed of 500 mm/min by using a dumbbell-shaped No. 3 test piece, and is determined from a stress at a time of 100% strain, in accordance with JIS K6251 (2010). As a measurement apparatus, Strograph AE Elastomer manufactured by Toyo Seiki Co., Ltd. is used.

Rebound Resilience

In the present example, rebound resilience of the portion of the cleaning blade 91 coming into contact with the surface of the photoconductor 32 (high-hardness surface layer 32*c*) is selected to be equal to or less than 30%.

The rebound resilience is determined by using a LUPKE-type rebound resilience tester in an environment of 23° C., in accordance with JIS K6255 (1996).

Use Condition of Cleaning Blade

Contact Pressure with Cleaning Blade

In the present example, the cleaning blade 91 comes into contact with the photoconductor 32 at a contact pressure of 2 to 4 (gf/mm: 9.80665 g·m/s$^2$).

Disposition Posture of Cleaning Blade

In the present example, for example, it is appropriate that an angle W/A (working angle) at a contact portion between the cleaning blade 91 and the photoconductor 32 is in a range equal to or more than 8° and equal to or less than 14°.

Adjustment of Friction Coefficient of Cleaning Blade

In order to adjust a friction coefficient of the cleaning blade 91, for example, hardness of the contact member 95 is adjusted and shifted to the higher hardness side, so that the friction coefficient can be adjusted in a lowering direction.

As another method, the friction coefficient can be adjusted by modifying a material surface of the contact member 95. Here, examples of the surface modification method for the contact member 95 include an ultraviolet irradiation treatment and an isocyanate impregnation treatment.

Surface Characteristic of Photoconductor

Surface Hardness Characteristic of Photoconductor In the present example, the photoconductor 32 includes the high-hardness surface layer 32*c*, and a specific example of the high-hardness surface layer 32*c* can be represented by the following hardness index.

(1) Universal Hardness

For example, the high-hardness surface layer 32*c* in the present example preferably has universal hardness equal to or more than 150 N/mm$^2$ and equal to or less than 220 N/mm$^2$, more preferably equal to or more than 170 N/mm$^2$ and equal to or less than 200 N/mm$^2$, and further preferably equal to or more than 180 N/mm$^2$ and equal to or less than 200 N/mm$^2$.

Further, for example, the high-hardness surface layer 32*c* in the present example preferably has an elastic deformation rate equal to or more than 45% and equal to or less than 65%, more preferably equal to or more than 45% and equal to or less than 60%, and further preferably equal to or more than 45% and equal to or less than 55%.

Specifically, the universal hardness and the elastic deformation rate are measured by using a Vickers square cone diamond indenter with a facing angle of 136° as an indenter, and as a measurement apparatus, a micro-hardness measurement apparatus Fischerscope H-100V (manufactured by Fischer), which requires continuous hardness, is used.

Universal hardness HU and an elastic deformation rate cannot be completely separated. For example, in a case where the HU exceeds 220 N/mm$^2$ and the elastic deformation rate is less than 44%, an elastic force of the high-hardness surface layer 32*c* is insufficient, so that deep scratches may occur on the high-hardness surface layer 32*c*. Further, in a case where the HU exceeds 220 N/mm$^2$ and the elastic deformation rate is larger than 65%, the elastic deformation amount becomes small even in a case where the elastic deformation rate is high, and in the same manner, deep scratches may occur on the high-hardness surface layer 32*c*. Further, in a case where the HU is less than 150 N/mm$^2$ and the elastic deformation rate exceeds 65%, the elastic deformation amount becomes large, and the high-hardness surface layer 32*c* is scraped by a cleaning member, a contact type charging roll, or the like, resulting in scratches, and scratches may occur.

The universal hardness and the elastic deformation rate controlled by adjusting types and contents of a specific charge transport material, a guanamine compound, and a melamine compound, a drying temperature and a drying time at a time of forming an outermost surface layer, a film thickness of the outermost surface layer, and the like.

For example, the universal hardness tends to be increased by increasing the content of the guanamine compound and the melamine compound, increasing the drying temperature at the time of forming the outermost surface layer, increasing the drying time, and the like. Further, the elastic deformation rate tends to be increased by increasing the content of the guanamine compound and the melamine compound, increasing the film thickness of the outermost surface layer, and the like.

(2) Surface Free Energy

The high-hardness surface layer 32*c* satisfies that a surface free energy is equal to or more than 10 mN/m and equal to or less than 30 mN/m.

The surface free energy of the high-hardness surface layer 32*c* can be controlled by, for example, addition of a silicone-based compound, a fluorine-based compound, a fatty acid metal salt, or the like.

Here, the surface free energy will be described.

There is wettability as a surface physical property that greatly affects a mutual adhesive force between toner mother particles including a toner or an external additive and the photoconductor, and it can be said that the lower the wettability of the surface of the photoconductor, the easier it is to remove (clean) the toner remaining on a surface of an electrophotographic photosensitive body after transferring a toner image. The wettability, that is, the adhesive force of the surface of the electrophotographic photosensitive body can be expressed by using the surface free energy (synonymous with surface tension) as an index.

(3) Elastic Deformation Rate Between Outermost Surface Layer and Lower Layer, and Universal Hardness In the present exemplary embodiment, the high-hardness surface layer 32*c* has an elastic deformation rate equal to or more than 45% and equal to or less than 55%, and a universal hardness equal to or more than 185 N/mm$^2$ and equal to or less than 210 N/mm$^2$, and a lower layer (corresponding to the charge transport layer) coming into contact with the high-hardness surface layer 32*c* has an elastic deformation rate equal to or more than 35% and equal to or less than 45%, and an universal hardness equal to or more than 180 N/mm$^2$ and equal to or less than 250 N/mm$^2$.

In the photoconductor according to the present example, the high-hardness surface layer 32*c* is hard to peel off from the lower layer, it is suppressed that foreign matter marks remain on the high-hardness surface layer 32*c* due to a carrier or the like, and abrasion of the high-hardness surface layer 32*c* is also suppressed. Specifically, since the elastic deformation rate of the high-hardness surface layer 32*c* is equal to or more than 45% and equal to or less than 55% and the universal hardness is equal to or more than 185 N/mm$^2$ and equal to or less than 210 N/mm$^2$, the high-hardness surface layer 32*c* can return to the original state even in a case where a foreign matter such as a carrier collides with the high-hardness surface layer 32*c*, and since the elastic deformation rate of the lower layer coming into contact with the high-hardness surface layer 32*c* is equal to or more than 35% and equal to or less than 45% and the universal hardness is equal to or more than 180 N/mm$^2$ and equal to or less than 250 N/mm$^2$, the high-hardness surface layer 32*c* is prevented from peeling off from the lower layer in a case where the foreign matter collides with the high-hardness surface layer 32*c* and returns to the original state. Therefore, it is possible to obtain the photoconductor that is resistant to foreign matter marks and is resistant to abrasion. This effect becomes remarkable by satisfying that a difference between the elastic deformation rate of the high-hardness surface layer 32*c* and the elastic deformation rate of the lower layer is equal to or less than 10%.

Here, the elastic deformation rates of the high-hardness surface layer 32*c* and the lower layer are performed under conditions of 25° C./50% RH, by using the Fischerscope H-100 (manufactured by Fischer Instruments).

For example, the elastic deformation rate of the high-hardness surface layer 32*c* is equal to or more than 45% and equal to or less than 55%, preferably equal to or more than 45% and equal to or less than 53%, and more preferably equal to or more than 45% and equal to or less than 51%. In a case where the elastic deformation rate of the high-hardness surface layer 32*c* is less than 45%, the original shape cannot be restored in a case where a foreign matter hits the outermost surface layer. In a case where the elastic deformation rate exceeds 55%, the original shape is likely to be restored, a difference in elastic deformation rate from the lower layer becomes large, and the high-hardness surface layer 32*c* is peeled off from the lower layer.

For example, the elastic deformation rate of the lower layer is equal to or more than 35% and equal to or less than 45%, preferably equal to or more than 35% and equal to or less than 43%, and more preferably equal to or more than 35% and equal to or less than 40%. In a case where the elastic deformation rate of the high-hardness surface layer 32*c* is less than 35%, a difference in the elastic deformation rate from the outermost surface layer becomes large, and peeling occurs between the lower layer and the high-hardness surface layer 32*c*. In a case where the elastic deformation rate exceeds 45%, the high-hardness surface layer 32*c* becomes too soft.

On the other hand, for example, the universal hardness of the high-hardness surface layer 32*c* is equal to or more than 185 $N/mm^2$ and equal to or less than 210 $N/mm^2$, preferably equal to or more than 185 $N/mm^2$ and equal to or less than 200 $N/mm^2$, and more preferably equal to or more than 185 $N/mm^2$ and equal to or less than 190 $N/mm^2$. In a case where the universal hardness of the high-hardness surface layer 32*c* is less than 185 $N/mm^2$, the high-hardness surface layer 32*c* is too soft, and the outermost surface layer is damaged by a foreign matter such as a carrier. On the other hand, in a case where the universal hardness exceeds 210 $N/mm^2$, the high-hardness surface layer 32*c* is too hard, and foreign matter marks such as carriers remain on the high-hardness surface layer 32*c*.

For example, the universal hardness of the lower layer is equal to or more than 180 $N/mm^2$ and equal to or less than 250 $N/mm^2$, preferably equal to or more than 190 $N/mm^2$ and equal to or less than 250 $N/mm^2$, and more preferably equal to or more than 200 $N/mm^2$ and equal to or less than 250 $N/mm^2$. In a case where the universal hardness of the high-hardness surface layer 32*c* is less than 180 $N/mm^2$, the high-hardness surface layer 32*c* is too soft, and the outermost surface layer is damaged by a foreign matter such as a carrier.

Further, for example, the difference between the elastic deformation rate of the high-hardness surface layer 32*c* and the elastic deformation rate of the lower layer is preferably equal to or less than 10%, more preferably equal to or more than 0% and equal to or less than 7%, and further preferably equal to or more than 0% and equal to or less than 5%. In a case where the difference between the elastic deformation rate of the high-hardness surface layer 32*c* and the elastic deformation rate of the lower layer exceeds 10%, a foreign matter may collide with the high-hardness surface layer 32*c*, and the high-hardness surface layer 32*c* may peel off from the lower layer in a case of returning to the original shape.

(4) Abrasion Rate

In the present example, an abrasion rate (abrasion amount per kilocycle) of the high-hardness surface layer 32*c* may be equal to or less than 3.5 nm/kcycle.

(5) Specifying by Material

In the present example, the high-hardness surface layer 32*c* is configured with a cross-linked product using at least one selected from a guanamine compound and a melamine compound, and at least one charge transport material having at least one of substituents selected from —OH, —$OCH_3$, —$NH_2$, —SH, and —COOH, and contains at least one selected from the guanamine compound and the melamine compound in an amount of 0.1% by mass or more and 5% by mass or less, and contains the charge transport material in an amount of 90% by mass or more.

Adjustment of Friction Coefficient on Photoconductor Surface

In a case of adjusting a friction coefficient on the surface of the photoconductor 32, lubricant particles may be added to the high-hardness surface layer 32*c* to adjust the amount of lubricant particles to be added. Examples of the lubricant particle include fluorine-based resin particles, which can be adjusted to a low friction coefficient by increasing the addition amount.

EXAMPLE

As illustrated in FIG. 5, Example 1 and Comparative Examples 1 to 3 in the following, blade use conditions, blade behavior (blade vibration), quality and filming, and the like are evaluated.

Example 1

Example 1 uses the cleaning blade used in Exemplary Embodiment 1, and the cleaning blade has high modulus (100% modulus is equal to or more than 7 Mpa) and low rebound resilience (rebound resilience equal to or less than 30%), and the photoconductor 32 having the high-hardness surface layer 32*c* (overcoated photoconductor: referred to as "overcoat" in FIG. 5) is cleaned as a cleaning target.

Comparative Example 1

In Comparative Example 1, a cleaning blade in the same manner as in Example 1 is used to clean an organic photoconductor (denoted as OPC in FIG. 5) having no high-hardness surface layer 32*c* as a cleaning target.

Comparative Example 2

In Comparative Example 2, a cleaning blade having a relatively low hardness and high rebound resilience is used to clean an organic photoconductor (OPC) having no high-hardness surface layer 32*c* as a cleaning target.

In Comparative Example 3, a cleaning blade in the same manner as in Comparative Example 2 is used to clean the photoconductor 32 (overcoated photoconductor) having the high-hardness surface layer 32*c* as a cleaning target.

First, in Comparative Example 2, vibration of the cleaning blade is large, and there is a high possibility that an external additive as an image forming residual particle slips through the cleaning blade. For supplement this point, as illustrated in FIG. 6B, since a cleaning blade 91' has a high friction coefficient, in a case where a tip corner portion 97 of the cleaning blade 91' is pressed against the photoconductor 32, the tip corner portion 97 repeats an operation of being pulled in following the movement of the photoconductor 32 while sliding with respect to the movement of the photoconductor 32 (stick and slip operation). Therefore, in the present example, blade vibration having a large amplitude and a small period occurs. In such a situation, the external additive slips through an edge of the cleaning blade 91', which has a relatively high contact pressure acting on the cleaning blade 91'. At this time, scratches are generated on the surface of the photoconductor 32, and the external additive is accumulated in a surface recess portion of the photoconductor 32, which leads to filming. Further, since the cleaning blade 91' has large vibration, slip-through of the external additive excessively occurs, and filming of the external additive is generated in a region other than the surface recess portion of the photoconductor 32 (see FIG. 7B). Further, since the vibration of the cleaning blade 91' increases fatigue fracture due to abrasion, it is necessary to increase the contact pressure of the cleaning blade 91' in anticipation of cleaning performance over time. Meanwhile, the frictional force also increases, and the cleaning blade 91' is initially curled up, which has a limit. Further, it is necessary to increase the contact pressure of the cleaning blade 91' so as to suppress the recess portion filming on the surface of the photoconductor, and there is a limit for the same reason. Therefore, it is difficult to extend the life of the photoconductor 32 or the cartridge including the photoconductor 32.

Further, in Comparative Example 3, since the overcoated photoconductor is used, scratches on the surface of the photoconductor are eliminated and the occurrence of recess portion filming is greatly suppressed. Meanwhile, the cleaning blade 91' still vibrates a lot (small period) as illustrated in FIG. 6A, so that the external additive slips through excessively, the cleaning cannot be completed, and the entire surface is filmed (see FIG. 7B). In the same manner as Comparative Example 2, the edge of the cleaning blade 91' becomes more fatigue fracture (abrasion) due to vibration, so that it is necessary to increase the contact pressure of the cleaning blade 91' in anticipation of cleaning performance over time. Meanwhile, the frictional force is also increased, and the initial cleaning blade 91' is curled up. Therefore, it is difficult to extend the life of the photoconductor 32 or the cartridge including the photoconductor 32.

On the other hand, in the example, by making the blade physical properties high modulus and low rebound resilience, as illustrated in FIG. 6A, stick-slip vibration can be suppressed (amplitude or period of vibration), and slip-through of the external additive may be suppressed. In addition, with the overcoated photoconductor 32, scratches on the surface of the photoconductor 32 are reduced, and the occurrence of recess portion filming is greatly suppressed. Further, since the amount of the external additive slip-through from the cleaning blade 91 is small, the occurrence of entire surface filming is greatly suppressed (see FIG. 7A).

In this manner, since vibration is suppressed at an edge of the cleaning blade 91, fatigue fracture (abrasion) is small and there is no change in the surface of the photoconductor 32. Therefore, only by combining these, the contact pressure of the cleaning blade 91 can be set low, at first time. Therefore, it is possible to extend the life of the photoconductor 32 and the cartridge.

Meanwhile, in Comparative Example 1, the cleaning blade 91 having high modulus and low rebound resilience in the same manner as in Example 1 and the organic photoconductor are combined, and as illustrated in FIG. 6A, the stick-slip vibration can be suppressed (amplitude or period of vibration) and the slip-through of the external additive can be suppressed, but the minimum slip-through of the external additive occurs so that the cleaning blade 91 is not curled up.

Figure 7A:
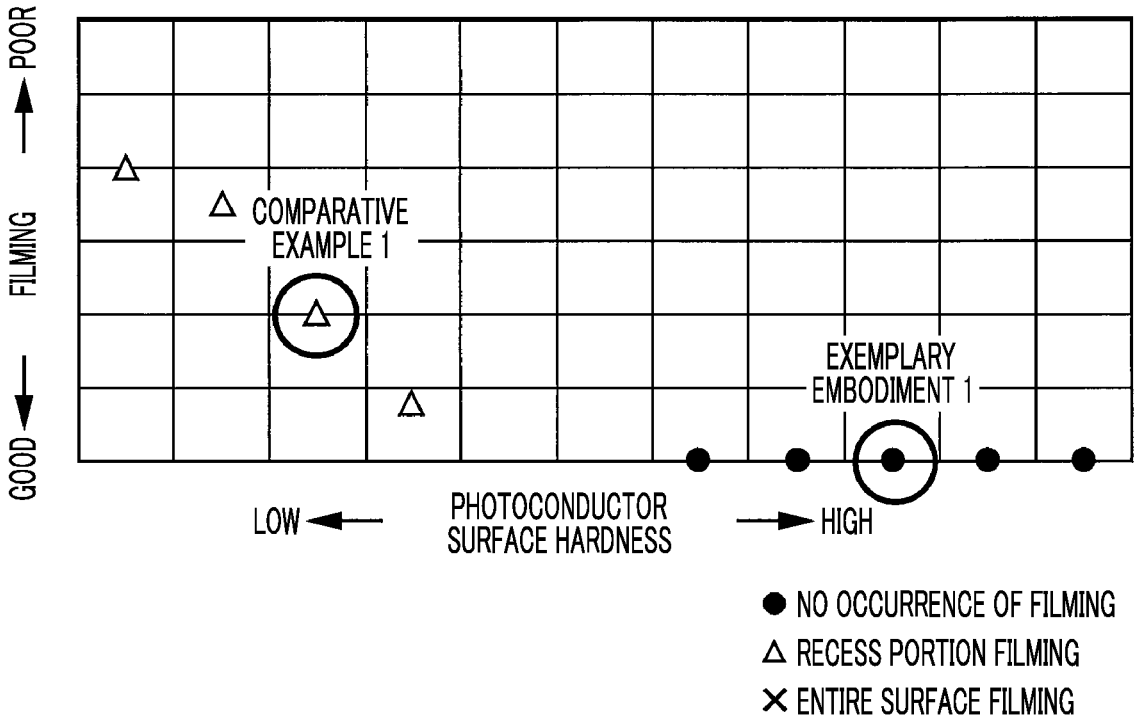
FIGS. 7A and 7B are explanatory diagrams illustrating a relationship between a use condition of the cleaning component according to Examples and Comparative Examples 1 to 3 and filming.
Figure 7B:
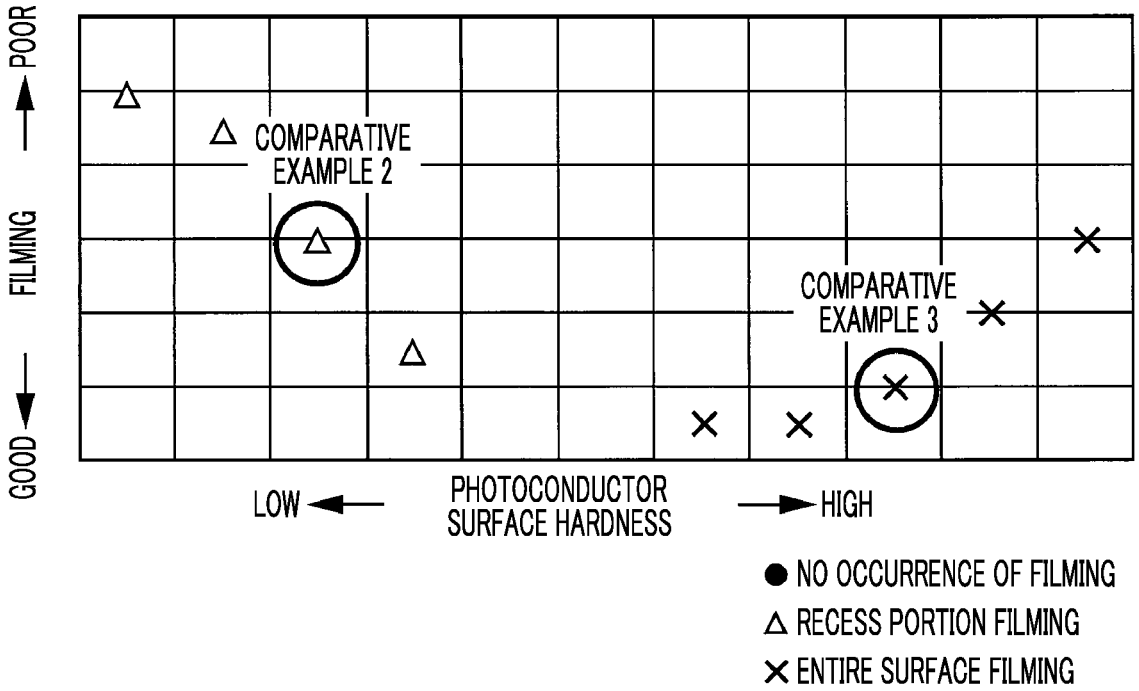

Therefore, in a case where the external additive slips through the edge of the cleaning blade 91 to which the contact pressure is applied, scratches are generated on the surface of the photoconductor, and the external additive is accumulated in the recess portion and filming occurs (see FIG. 7A). It is necessary to increase the contact pressure of the cleaning blade 91 in order to suppress the recess portion filming on the surface of the photoconductor. Meanwhile, there is a limit for the same reason as in Comparative Example 2. Therefore, it is difficult to extend the life of the photoconductor and the cartridge.

Characteristic Evaluation of Cleaning Blade

In the present example, the cleaning blade 91 has characteristics of high modulus and low rebound resilience (equal to or more than 7 Mpa and rebound resilience equal to or less than 30%), and rationale data to support the numerical value limitation is described.

Cleaning blades having different characteristics of 100% modulus and rebound resilience are prepared, and the presence or absence of occurrence of filming is visually confirmed by using each cleaning blade. As a result, the results illustrated in FIG. 8 are obtained.

Figure 8:
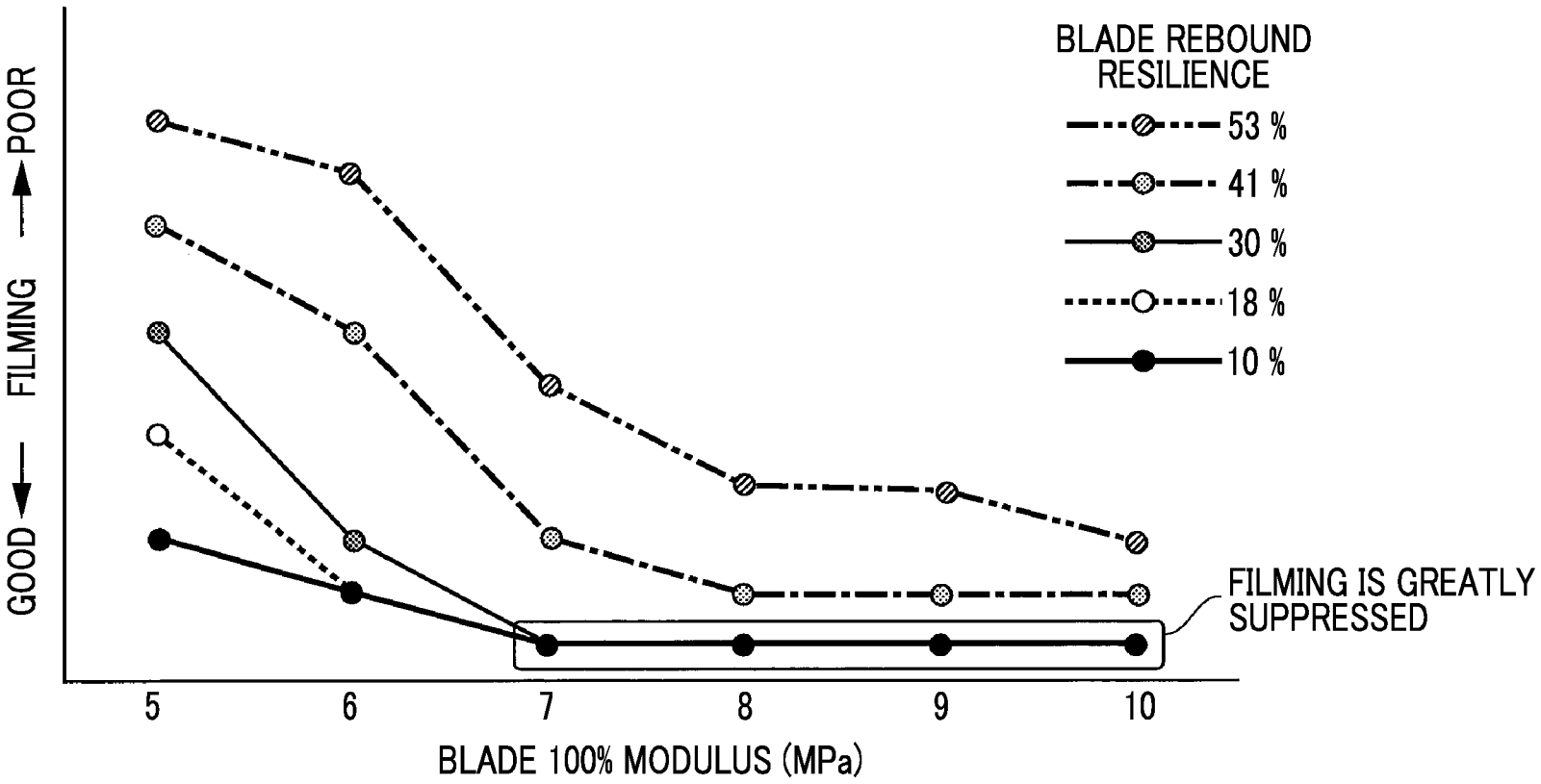
FIG. 8 is an explanatory diagram illustrating a relationship between 100% modulus, rebound resilience, and filming of the cleaning component.

As illustrated in FIG. 8, in a combination of

[100% modulus]: 5, 6, 7, 8, 9, and 10 (unit: Mpa)

[rebound resilience]: 10, 18, 30, 41, and 53 (unit: %), after presence or absence of filming is checked, occurrence of filming is greatly suppressed in a combination of 100% modulus of 7, 8, 9, and 10 and rebound resilience of 10, 18, and 30.

According to this result, it is understood that the characteristic of the cleaning blade 91 is that the occurrence of filming is suppressed under a condition that 100% modulus is equal to or more than 7 Mpa and rebound resilience is equal to or less than 30%.

Measurement of Friction Coefficient Over Time on Photoconductor Surface

In the present example, the photoconductor 32 uses a so-called overcoated photoconductor (photoconductor having the high-hardness surface layer 32*c*), and as a measurement apparatus, HEIDON manufactured by HEIDON (Shinto Scientific Co., Ltd.) is used to measure a friction coefficient of a surface of the photoconductor after 10 kpv running.

The measurement conditions are as follows.

Needle material: diamond

Needle tip R: 0.1 mmR

Movement interval: 10 mm

Movement speed: 5 mm/sec

Load: 15 g

Number of measurements: 15 times

Adopted data: average

The measurement result is after 0.3 to 0.7/10 kpv running.

Since a friction coefficient on a surface of a photoconductor is approximately 0.1 to 0.2 so far, it is checked that occurrence of filming is greatly suppressed in the photoconductor.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning component that cleans an image holding section having a high-hardness surface layer, the cleaning component comprising:

a plate-shaped cleaning member coming into contact with a surface of the image holding section, wherein a portion of the cleaning member coming into contact with the surface of the image holding section has 100% modulus equal to or more than 7 Mpa and rebound resilience from 5% to 10%, as physical properties.

2. The cleaning component according to claim 1, wherein the cleaning member includes a contact member having a portion coming into contact with the surface of the image holding section and a non-contact member having a portion that is not coming into contact with the surface of the image holding section, and 100% modulus of the non-contact member is smaller than 100% modulus of the contact member.

3. The cleaning component according to claim 2, wherein the cleaning member has the contact member and the non-contact member made of identical materials having 100% modulus different from each other.

4. The cleaning component according to claim 3, wherein the cleaning member comes into contact with the surface of the image holding section at a contact pressure of 2 to 4 (gf/mm).

5. The cleaning component according to claim 2, wherein the cleaning member has the contact member and the non-contact member made of different materials having 100% modulus different from each other.

6. The cleaning component according to claim 5, wherein the cleaning member comes into contact with the surface of the image holding section at a contact pressure of 2 to 4 (gf/mm).

7. The cleaning component according to claim 2, wherein the cleaning member comes into contact with the surface of the image holding section at a contact pressure of 2 to 4 (gf/mm).

8. The cleaning component according to claim 1, wherein the cleaning member comes into contact with the surface of the image holding section at a contact pressure of 2 to 4 (gf/mm).

9. The cleaning component according to claim 1, wherein the portion of the cleaning member coming into contact with the surface of the image holding section is adjusted to have a predetermined friction coefficient of 0.1 to 1.5 by using at least any rubber material of polyurethane rubber, silicone rubber, or fluororubber.

10. The cleaning component according to claim 9, wherein in the cleaning member, the friction coefficient is adjusted by adjusting hardness of the rubber material.

11. The cleaning component according to claim 9, wherein in the cleaning member, the friction coefficient is adjusted by modifying a surface of the rubber material.

12. The cleaning component according to claim 1, wherein the portion of the cleaning member coming into contact with the surface of the image holding section is configured by using at least polyurethane rubber, and is obtained by selecting types, molar ratios, and curing/maturing conditions of a polyol component and a polyisocyanate component that are composition components of the polyurethane rubber to satisfy physical properties of the 100% modulus and the rebound resilience.

13. A cleaning apparatus comprising:

the cleaning component according to claim 1.

14. A process cartridge comprising:

the cleaning apparatus according to claim 13; and an image holding section having a high-hardness surface layer, wherein the process cartridge is detachably attached to an image forming apparatus housing.

15. An image forming apparatus comprising:

an image holding section that includes a high-hardness surface layer;

a latent image forming section that forms an electrostatic latent image on the image holding section;

a developing section that visualizes the electrostatic latent image formed on the image holding section with an image forming particle;

a transfer section that transfers a visible image formed on the image holding section to a transfer medium; and the cleaning apparatus according to claim 13, that cleans an image forming residual particle of the image holding section.

16. The image forming apparatus according to claim 15, wherein the image holding section has a friction coefficient of 0.3 to 0.7 after 10 kpv running.

17. The image forming apparatus according to claim 15, wherein a friction coefficient of the high-hardness surface layer of the image holding section is adjusted by adjusting an amount of lubricant particles to be added.

* * * * *